US007143528B2

(12) United States Patent
Kolb

(10) Patent No.: US 7,143,528 B2
(45) Date of Patent: Dec. 5, 2006

(54) DRY CONVERTING PROCESS AND APPARATUS

(75) Inventor: William Blake Kolb, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/810,065

(22) Filed: Mar. 26, 2004

(65) Prior Publication Data

US 2004/0231185 A1 Nov. 25, 2004

Related U.S. Application Data

(63) Continuation-in-part of application No. 10/421,195, filed on Apr. 23, 2003, which is a continuation-in-part of application No. 09/960,131, filed on Sep. 21, 2001, now Pat. No. 6,553,689.

(60) Provisional application No. 60/274,050, filed on Mar. 7, 2001, provisional application No. 60/235,221, filed on Sep. 24, 2000, provisional application No. 60/235,214, filed on Sep. 24, 2000.

(51) Int. Cl.
*F26B 3/00* (2006.01)
*F26B 21/06* (2006.01)

(52) U.S. Cl. ..... 34/451; 34/559; 34/207; 34/209; 34/618; 34/629

(58) Field of Classification Search ..... 34/540, 34/559, 207, 208, 209, 618, 629, 651, 430, 34/431, 432, 433, 434, 435, 451, 500, 503, 34/504, 507, 508, 509, 510; 162/199, 201, 162/252, 207, 194, 198
See application file for complete search history.

(56) References Cited

U.S. PATENT DOCUMENTS

| | | | | |
|---|---|---|---|---|
| 1,494,830 | A | 5/1924 | Cook | |
| 2,157,388 | A | 5/1939 | MacArthur | |
| 2,815,307 | A | 12/1957 | Beck | |
| 3,071,869 | A | 1/1963 | Latimer et al. | |
| 3,408,748 | A | 11/1968 | Dunn | |
| 3,452,447 | A | 7/1969 | Gardner | |
| 3,542,640 | A * | 11/1970 | Adams et al. | 162/101 |
| 3,931,684 | A | 1/1976 | Turnbull et al. | |
| 4,012,847 | A | 3/1977 | Rand | |
| 4,051,278 | A | 9/1977 | Democh | |
| 4,053,990 | A | 10/1977 | Bielinski | |
| 4,223,450 | A | 9/1980 | Rothchild | |
| 4,263,724 | A | 4/1981 | Vits | |

(Continued)

FOREIGN PATENT DOCUMENTS

DE 499 308 5/1930

(Continued)

OTHER PUBLICATIONS

Schiffbauer, R.; "AbluftreinigungDurch Losemittelruckgewinnung", Linde Berichte Aus Technik Und Wissenschaft, Linde AG. Wiesbaden, DE, No. 64, 1990, pp. 45-52, XP000114324, Translation attached.

*Primary Examiner*—Kenneth Rinehart
(74) *Attorney, Agent, or Firm*—Rick L. Franzen

(57) ABSTRACT

A web converting process and apparatus employing a dry converting station and substrate-handling equipment for conveying the substrate through the dry converting station. The substrate is enveloped in the dry converting station by a close enclosure supplied with one or more streams of conditioned gas flowing at a rate sufficient to reduce materially the particle count in the close enclosure.

65 Claims, 11 Drawing Sheets

U.S. PATENT DOCUMENTS

| | | | | |
|---|---|---|---|---|
| 4,268,977 | A | | 5/1981 | Geiger |
| 4,369,584 | A | | 1/1983 | Daane |
| 4,462,169 | A | | 7/1984 | Daane |
| 4,752,217 | A | | 6/1988 | Justus |
| 4,894,927 | A | | 1/1990 | Ogawa et al. |
| 4,926,567 | A | | 5/1990 | Ogawa |
| 4,951,401 | A | | 8/1990 | Suzuki et al. |
| 5,168,639 | A | | 12/1992 | Hebels |
| 5,333,395 | A | | 8/1994 | Bulcsu |
| 5,528,839 | A | * | 6/1996 | Seidl ..... 34/364 |
| 5,536,333 | A | * | 7/1996 | Foote et al. ..... 136/260 |
| 5,579,590 | A | * | 12/1996 | Seidl et al. ..... 34/559 |
| 5,581,905 | A | | 12/1996 | Huelsman et al. |
| 5,694,701 | A | | 12/1997 | Huelsman et al. |
| 5,813,133 | A | | 9/1998 | Munter et al. |
| 5,906,862 | A | | 5/1999 | Yapel et al. |
| 5,980,697 | A | | 11/1999 | Kolb et al. |
| 6,047,151 | A | | 4/2000 | Carvalho et al. |
| 6,117,237 | A | | 9/2000 | Yapel et al. |
| 6,134,808 | A | | 10/2000 | Yapel et al. |
| 6,207,020 | B1 | | 3/2001 | Anderson |
| 6,256,904 | B1 | | 7/2001 | Kolb et al. |
| 6,280,573 | B1 | | 8/2001 | Lindsay et al. |
| 6,308,436 | B1 | | 10/2001 | Stipp |
| 6,375,874 | B1 | * | 4/2002 | Russell et al. ..... 264/28 |
| 6,431,858 | B1 | | 8/2002 | Rutz |
| 6,511,708 | B1 | | 1/2003 | Kolb et al. |
| 6,553,689 | B1 | | 4/2003 | Jain et al. |
| 6,562,412 | B1 | | 5/2003 | Fontaine |
| 6,565,017 | B1 | * | 5/2003 | Fath et al. ..... 239/533.3 |

FOREIGN PATENT DOCUMENTS

| | | | |
|---|---|---|---|
| DE | 42 43 515 | A1 | 6/1994 |
| GB | 713612 | | 8/1954 |
| GB | 1 401 041 | | 7/1975 |
| GB | 2 079 913 | A | 1/1982 |
| JP | 09-073016 | | 3/1997 |
| JP | 2001-170547 | | 6/2001 |
| JP | 2003-093952 | A | 4/2003 |
| JP | 2003-093953 | A | 4/2003 |
| JP | 2003-0939952 | A | 4/2003 |
| WO | WO 02/25193 | A1 | 3/2002 |

* cited by examiner

DRY CONVERTING PROCESS AND APPARATUS

CROSS-REFERENCE TO RELATED APPLICATIONS

This application is a continuation-in-part of and claims priority to U.S. patent application Ser. No. 10/421,195, filed Apr. 23, 2003, which in turn is a continuation-in-part of and claims priority to U.S. patent application Ser. No. 09/960,131, filed Sep. 21, 2001 (now U.S. Pat. No. 6,553,689 B2), which in turn claims priority to U.S. Provisional Application Ser. Nos. 60/235,214, filed Sep. 24, 2000, 60/235,221, filed Sep. 24, 2000, and 60/274,050, filed Mar. 7, 2001, all of which are hereby incorporated by reference in their entirety.

FIELD OF THE INVENTION

This invention relates to processes and equipment for converting moving substrates of indefinite length.

BACKGROUND

Moving substrates of indefinite length (viz., moving webs) can be converted in a variety of ways from one state or shape to another state or shape. Some converting processes produce considerable debris, or are carried out in the presence of airborne particulates or other contaminants, or may require a controlled environment when ordinary ambient air conditions might disrupt the converting process or pose a safety hazard. This can be a particular problem in dry converting operations, when static buildup may cause debris, particulates or other contaminants to adhere to the moving substrate. For example, optical-grade coatings on plastic films are especially sensitive to contamination, which may cause visible defects.

Typical controlled environments include clean rooms and the use of inert, low oxygen or saturated atmospheres. Clean rooms and special atmospheres require costly auxiliary equipment and large volumes of filtered air or specialty gases. For example, a typical clean room operation may require many thousands of liters per minute of filtered air.

SUMMARY OF THE INVENTION

The disclosed invention includes a process and apparatus for dry converting a moving substrate of indefinite length in a controlled environment using low volumes of filtered air or specialty gases. The disclosed process and apparatus utilize a close enclosure that envelops the moving substrate during at least the converting operation, the close enclosure being supplied with one or more streams of conditioned gas flowing at a rate sufficient to reduce materially the close enclosure particle count. The invention thus provides in one aspect a process for dry converting a moving substrate of indefinite length comprising conveying the substrate through a dry converting station in a close enclosure while supplying the enclosure with one or more streams of conditioned gas flowing at a rate sufficient to reduce materially the particle count in the close enclosure.

The invention provides in another aspect an apparatus for converting a moving substrate of indefinite length comprising a dry converting station and substrate-handling equipment for conveying the substrate through the dry converting station, the substrate being enveloped in the dry converting station by a close enclosure supplied with one or more streams of conditioned gas flowing at a rate sufficient to reduce materially the particle count in the close enclosure.

The invention provides in yet another aspect a process for dry converting a moving substrate of indefinite length comprising conveying the substrate through a dry converting station in a close enclosure while supplying the enclosure with one or more streams of conditioned gas flowing at a rate sufficient to cause a material change in a physical property of interest for the atmosphere in the close enclosure.

The invention provides in yet another aspect an apparatus for converting a moving substrate of indefinite length comprising a dry converting station and substrate-handling equipment for conveying the substrate through the dry converting station, the substrate being enveloped in the dry converting station by a close enclosure supplied with one or more streams of conditioned gas flowing at a rate sufficient to cause a material change in a physical property of interest for the atmosphere in the close enclosure.

BRIEF DESCRIPTION OF THE DRAWING

The above, as well as other advantages of the disclosed invention will become readily apparent to those skilled in the art from the following detailed description when considered in light of the accompanying drawing in which.

Like reference symbols in the various figures indicate like elements. The elements in the drawing are not to scale.

DETAILED DESCRIPTION

Figure 1:
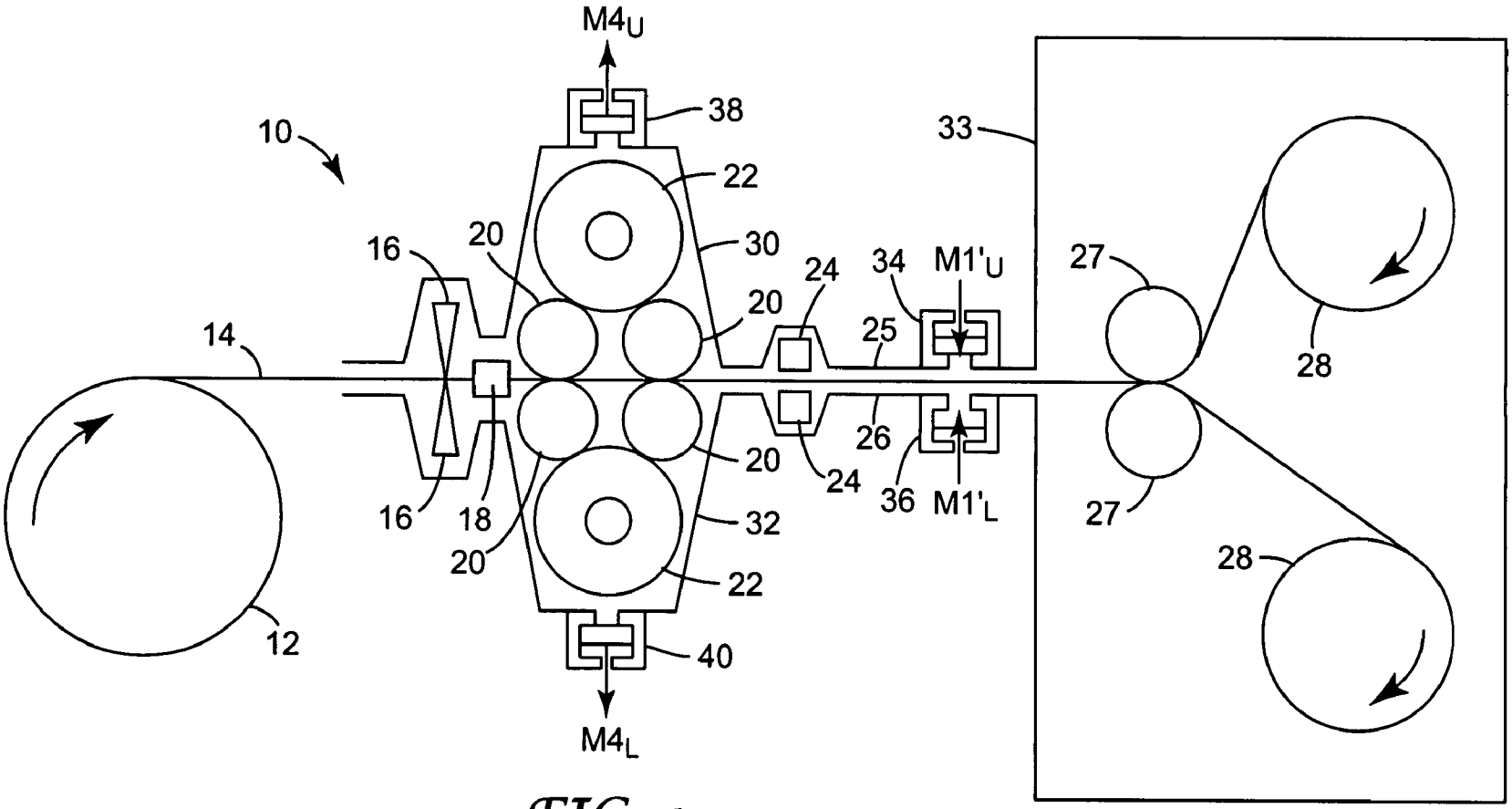
FIG. 1 is a schematic side sectional view of a disclosed slitting/cleaning apparatus.

When used with respect to a flexible moving substrate or an apparatus conveying such substrates, the phrase "dry converting" refers to an operation carried out without applying or drying a wet coating on the substrate, wherein the operation changes the substrate's cleanliness state, surface energy, shape, thickness, crystallinity, elasticity or transparency. Dry converting may include, for example, operations such as cleaning (e.g., plasma treating or the use of tacky rolls), electrically priming (e.g., corona-treating), slitting, cutting into pieces, splitting (e.g., stripping into sheets), laminating, stretching (e.g., orienting), folding (e.g., corrugating), thermoforming, masking, demasking, vapor coating, heating or cooling.

When used with respect to an apparatus for converting a moving substrate or a component or station in such an apparatus, the phrase "dry converting station" refers to a device that carries out dry converting.

When used with respect to a moving substrate or an apparatus for converting such substrates, the words "downstream" and "upstream" refer respectively to the direction of substrate motion and its opposite direction.

When used with respect to an apparatus for converting a moving substrate or a component or station in such an apparatus, the words "leading" and "trailing" refer respectively to regions at which the substrate enters or exits the recited apparatus, component or station.

When used with respect to a moving substrate or an apparatus for converting such substrates, the word "width" refers to the length perpendicular to the direction of substrate motion and in the plane of the substrate.

When used with respect to an apparatus for converting a moving substrate or a component or station in such an apparatus, the phrase "web-handling equipment" refers to a device or devices that transport the substrate through the apparatus.

When used with respect to an enclosed apparatus for converting a moving substrate or an enclosed component or station in such an apparatus, the phrase "control surface" refers to a surface that is generally parallel to a major face of the substrate and located sufficiently close to the substrate so that an atmosphere that may affect the substrate is present between the control surface and the substrate. A control surface may include for example an enclosure housing, a separate plate, the walls of a slit, or other surface having an appreciable area generally parallel to a major face of the substrate.

When used with respect to an enclosed apparatus for converting a moving substrate or an enclosed component or station in such an apparatus, the word "overlying" refers to an apparatus, component or station that would be above the substrate if the substrate is envisioned in a horizontal orientation.

When used with respect to an enclosed apparatus for converting a moving substrate or an enclosed component or station in such an apparatus, the word "underlying" refers to an apparatus, component or station that would be below the substrate if the substrate is envisioned in a horizontal orientation.

When used with respect to an enclosed apparatus for converting a moving substrate or an enclosed component or station in such an apparatus, the word "headspace" refers to the distance from the substrate to an overlying nearby control surface measured perpendicular to the substrate if the substrate is envisioned in a horizontal orientation.

When used with respect to an enclosed apparatus for converting a moving substrate or an enclosed component or station in such an apparatus, the word "footspace" refers to the distance from the substrate to an underlying nearby control surface measured perpendicular to the substrate if the substrate is envisioned in a horizontal orientation.

When used with respect to an enclosed apparatus for converting a moving substrate or an enclosed component or station in such an apparatus, the phrase "close enclosure" refers to an enclosure whose average headspace plus average footspace throughout the enclosure is no greater than about 30 cm.

When used with respect to an enclosed apparatus for converting a moving substrate or an enclosed component or station in such an apparatus, the phrase "conditioned gas" refers to gas that is different from the ambient air surrounding the apparatus in at least one property of interest.

When used with respect to an enclosed apparatus for converting a moving substrate or an enclosed component or station in such an apparatus, the phrase "particle count" refers to the number of 0.5 μm or larger particles in a volume of 28.3 liters.

When used with respect to a physical property of interest (e.g., the particle count) for the atmosphere in an enclosed apparatus for converting a moving substrate or an enclosed component or station in such an apparatus, the word "material" refers to at least a 50% reduction or increase in the property of interest compared to the ambient air surrounding the apparatus, component or station.

When used with respect to an enclosed apparatus for converting a moving substrate or an enclosed component or station in such an apparatus, the phrase "negative pressure" refers to pressure below that of the ambient air surrounding the apparatus, component or station, and the phrase "positive pressure" refers to a pressure above that of the ambient air surrounding the apparatus, component or station.

When used with respect to an apparatus for converting a moving substrate or a component or station in such an apparatus, the phrase "pressure gradient" refers to a pressure differential between an interior portion of the apparatus, component or station and that of the ambient air surrounding the apparatus, component or station.

A webline employing a slitter/cleaner in a close enclosure is shown in schematic side sectional view in FIG. 1. Unwind reel 12 supplies web 14 to slitter blades 16. Unwind reel 12 may optionally be enclosed in a suitable cabinet may be unventilated, ventilated with ambient air, or supplied with a suitable conditioned gas stream as desired. Edge vacuums 18 remove contamination from the outer and slit edges of web 14, and rubber rolls 20 and tacky rolls 22 remove contamination from the major faces of web 14. Static eliminator bars 24 remove charge from web 14. After passing over transfer rolls 27, the slit portions of web 14 are individually wound on take-up reels 28 located inside cabinet 33. Cabinet 33 typically does not benefit from employing a close enclosure, and instead desirably has a sufficiently roomy and uncluttered interior to house the slit web rolls and permit easy roll changeover and transport. Cabinet 33 may be unventilated, ventilated with ambient air, or supplied with a suitable conditioned gas stream as desired.

The slitter/cleaner components are enveloped by a close enclosure 10 formed by overlying housing 30 and underlying housing 32. Housings 30, 32 may conform closely to the shape of the slitter/cleaner components to provide a reduced interior atmosphere and reduced interior volume. A further close enclosure and transition zone formed by overlying control surface 25 and underlying control surface 26 is interconnected to close enclosure 10 and is connected to cabinet 33. Upper and lower manifolds 34 and 36 respectively may provide gas flows into or out of the apparatus (e.g., conditioned gas streams $M1'_U$ and $M1'_L$) at a point downstream from the slitter/cleaner components. Conditioned gas streams $M1'_U$ and $M1'_L$ desirably differ from the ambient air by having a lower particle count, but may in addition or instead differ in another property of interest, e.g., a different chemical composition due to the absence or presence of one or more gases (including humidity) or a different temperature. Upper and lower manifolds 38 and 40 respectively may provide gas flows into or out of close enclosure 10 (e.g., withdrawn gas streams $M4_U$ and $M4_L$).

Figure 2:
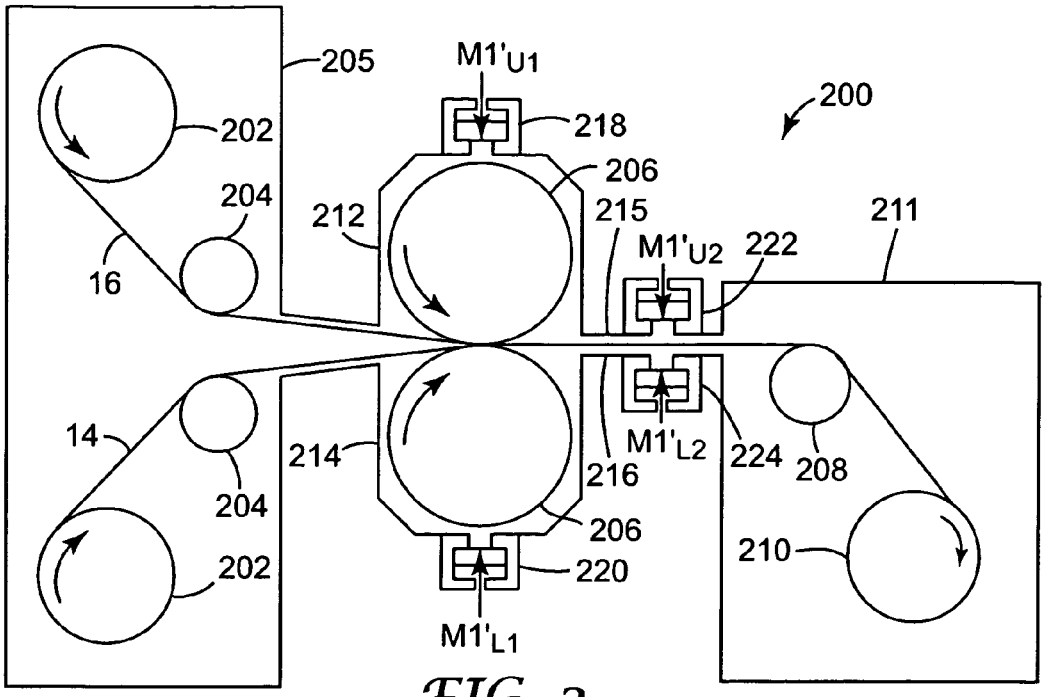
FIG. 2 is a schematic side sectional view of a disclosed laminating apparatus.

FIG. 2 shows a schematic side sectional view of laminator 200. Unwind reels 202 and transfer rolls 204 are located inside cabinet 205. Cabinet 205 may be unventilated, ventilated with ambient air, or supplied with a suitable conditioned gas stream as desired. Webs 14 and 16 pass over transfer rolls 204, between lamination rolls 206, over transfer roll 208 and onto takeup roll 210 inside cabinet 211. Cabinet 211 may be unventilated, ventilated with ambient air, or supplied with a suitable conditioned gas stream as desired. The lamination rolls 206 are enveloped by a close enclosure formed by overlying housing 212 and underlying housing 214. This close enclosure is connected to cabinet 211. Housings 212, 214 may conform closely to the shape of the rolls 206 to provide a reduced interior atmosphere and reduced interior volume. A further close enclosure and transition zone formed by overlying control surface 215 and underlying control surface 216 is interconnected to the close enclosure formed by housings 212, 214 and is connected to cabinet 211. Upper manifolds 218, 222 and lower manifolds 220, 224 respectively may provide gas flows into or out of the apparatus (e.g., conditioned gas streams $M1'_{U1}$, $M1'_{U2}$, $M1'_{L1}$ and $M1'_{L2}$). One or more of conditioned gas streams $M1'_{U1}$, $M1'_{U2}$, $M1'_{L1}$ and $M1'_{L2}$ desirably differ from the ambient air by having a lower particle count, but may in addition or instead differ in another property of interest, e.g., a different chemical composition due to the absence or presence of one or more gases (including humidity) or a different temperature.

The disclosed process and apparatus do not need to employ all the close enclosures shown in FIG. 1 and FIG. 2, and may employ different close enclosures or processes than those shown or more close enclosures or processes than those shown. Two or more of the disclosed close enclosures may be interconnected in series in a web process thereby creating multiple successive zones or applications. Each individual close enclosure may be operated at different pressures, temperatures and headspace or footspace gaps to address process and material variants. Individual close enclosures may have none, one or more than one conditioned gas inputs or gas withdrawal devices. A positive pressure could be maintained or established in some close enclosures and a negative pressure in other close enclosures. For processes in which cleanliness is a concern, use of interconnected close enclosures is recommended from at least the first point at which debris or other contaminants may arise or pose a problem (e.g., after a slitter or before lamination rolls) up to at least a station at which debris or other contaminants may no longer pose a problem. Such interconnection can provide continuous protection that may reduce substrate contamination and facilitate control of the particle count in the atmosphere immediately surrounding the substrate while using only small volumes of conditioned gases. Additional control of converting conditions may be achieved by employing a close enclosure or series of interconnected close enclosures from at least the first dry converting station in a process, or from at least the first point at which debris or other contaminants may arise or pose a problem, up to or through at least the last dry converting station in a process (e.g., a cutting, slitting or folding station). Additional control may also be achieved by employing a close enclosure from the first dry converting station in a process (e.g., a cleaning or priming station) up to or through at least the last dry converting station in the process, up to a takeup reel or up to a packaging station. In one exemplary embodiment the coated substrate is not exposed to ambient air from at least the time the substrate is unwound until it has been wound on a takeup reel or packaged. The disclosed apparatus may also include one or more sections that do not represent a close enclosure, but desirably the number, total volume and gas flow patterns of such sections is such that undesirable contamination of the substrate does not arise.

If desired, conditioned gas streams could be injected (or gas could be withdrawn) at more or fewer locations than are shown in FIG. 1 and FIG. 2. In one exemplary embodiment, a conditioned gas stream could be injected at the first of several interconnected close enclosures, and the conditioned gas could be carried along with the moving substrate to the downstream close enclosures or pushed to an upstream enclosure or process. In another exemplary embodiment, conditioned gas streams could be injected wherever needed to maintain or establish a slight positive pressure in each of several interconnected close enclosures. In yet another exemplary embodiment, conditioned gas streams could be injected where needed to maintain or establish a slight positive pressure in some of several interconnected close enclosures, and a slight negative or zero pressure could be maintained or established in other interconnected close enclosures. In yet another exemplary embodiment, conditioned gas streams could be injected at each of several interconnected close enclosures.

A cleanroom could optionally surround the disclosed apparatus. However, this could be of a much lower classification and much smaller volume than that which might typically be used today. For example, the cleanroom could be a portable model using flexible hanging panel materials. Also, a variety of web support systems that will be familiar to those skilled in the art may be employed in the disclosed process and apparatus, including porous air tubes, air bars, and air foils.

In one embodiment of the disclosed process, a moving substrate of indefinite length has at least one major surface with an adjacent gas phase. The substrate is treated with an apparatus having a control surface in close proximity to a surface of the substrate to define a control gap between the substrate and the control surface. The control gap may be referred to as the headspace or footspace between the substrate and the nearby control surface.

A first chamber may be positioned near a control surface, with the first chamber having a gas introduction device. A second chamber may be positioned near a control surface, the second chamber having a gas withdrawal device. The control surface and the chambers together define a region wherein the adjacent gas phases possess an amount of mass. At least a portion of the mass from the adjacent gas phases is transported through the gas withdrawal device by inducing a flow through the region. The mass flow can be segmented into the following components:

- M1 means total net time-average mass flow per unit of substrate width into or out of the region resulting from pressure gradients,
- M1' means the total net time-average mass flow of a gas per unit width into the region through the first chamber from the gas introduction device, M2 means the time-average mass flow of conditioned gas per unit width from or into the at least one major surface of the substrate into or from the region, M3 means total net time-average mass flow per unit width into the region resulting from motion of the material, and M4 means time-average rate of mass transport through the gas withdrawal device per unit width, where "time-average mass flow" is represented by the equation $$MI = \frac{1}{t}\int_0^t mi\,dt,$$

wherein MI is the time-average mass flow in kg/second, t is time in seconds, and mi is the instantaneous mass flow in kg/second.

The mass flow in the gas phase is represented by the equation:

$$M1+M1'+M2+M3=M4 \qquad \text{(Equation A).}$$

Figure 3:
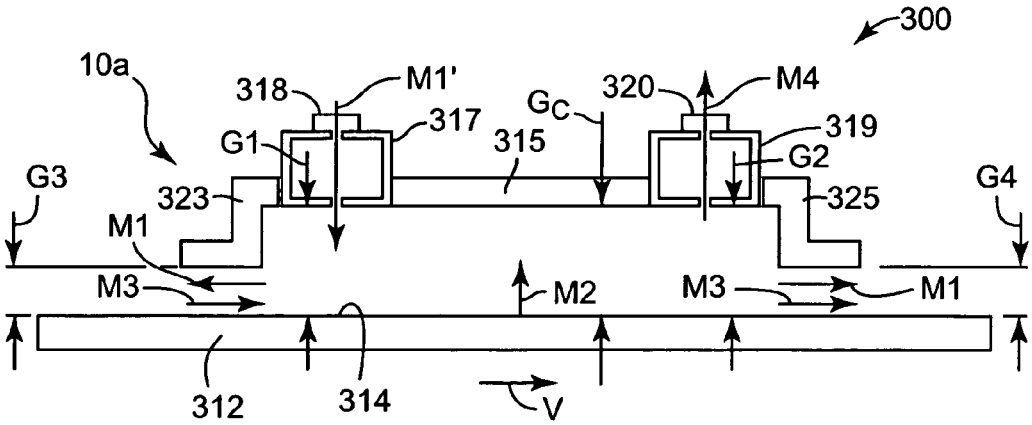
FIG. 3 is a schematic side sectional view of a disclosed close enclosure.

M1, M1', M2, M3 and M4 are further illustrated in FIG. 3. FIG. 3 is a schematic side sectional view of a close enclosure 300. A substrate 312 has at least one major surface 314 with an adjacent gas phase (not shown in FIG. 3). The substrate 312 is in motion in the direction of arrow "V" under a control surface 315, thus defining a control gap "$G_C$". A first chamber 317 having a gas introduction device 318 is positioned near the control surface 315. The exact form of the gas introduction device 318 may vary, and expedients such as a gas knife, a gas curtain, or a gas manifold can be used. While the illustrated embodiment depicts first chamber 317 in the form of a plenum, it is not necessary that the gas introduction device 318 be positioned at a remove from the level of control surface 315. A second chamber 319 is also positioned near the control surface 315, and has a gas withdrawal device 320. Once again, while the illustrated embodiment depicts the second chamber 319 in the form of a plenum, it is not necessary that the gas withdrawal device 320 be positioned at the level of control surface 315. In an exemplary embodiment, the first chamber 317 and the second chamber 319 will be at opposing ends of the control surface 315 as depicted in FIG. 3. The first chamber 317 defines a first gap G1 between the first chamber 317 and the substrate 312. The second chamber 319 defines a second gap G2 between the second chamber 319 and the substrate 312. In some embodiments, the first gap G1, the second gap G2, and the control gap $G_C$ are all of equal height, however in other embodiments, at least one of the first gap G1 or the second gap G2 has a height different than the control gap $G_C$. Best results appear to be achieved when the first gap, second gap and control gap are all 10 cm or less. In some exemplary embodiments the first gap, the second gap, and the control gap are all 5 cm or less, 3 cm or less, or even smaller values, e.g., 2 cm or less, 1.5 cm or less, or 0.75 cm or less. The airflow required to attain a desired low particle count may vary in part with the square of the combined headspace and footspace, and accordingly the disclosed gaps desirably have relatively small values. Similarly, best results appear to be achieved when the total of the average headspace and average footspace is 10 cm or less, 5 cm or less, 3 cm or less, or even smaller values, e.g., 2 cm or less, 1.5 cm or less, or 0.75 cm or less.

In addition to gaps $G_C$, G1 and G2, control of the atmosphere near the substrate may also be aided by using mechanical features, such as extensions 323 and 325 in FIG. 3. The extensions 323 and 325, having gaps G3 and G4, may be added to one of both of the upstream or downstream ends of the apparatus. Those skilled in the art will recognize that the extensions may be affixed to various members of the apparatus or provided with alternate shapes depending on the specific embodiment selected for a particular purpose. Flows M1 and M3 may be reduced as the substrate area "covered" by the extensions increases. The adjacent gas phase between the control surface 315, first chamber 317, second chamber 319 and the surface 314 of the substrate 312 define a region possessing an amount of mass. The extensions 323 and 325 may further define the region under the control surface having an adjacent gas phase possessing an amount of mass. The mass in the region is generally in a gas phase. However, those skilled in the art will recognize that the region may also contain mass that is in either the liquid or solid phase, or combinations of all three phases.

FIG. 3 depicts the various flow streams encountered in close enclosure 300 when practicing the disclosed process. M1 is the total net time-average mass flow per unit width into or out of the region resulting from pressure gradients. M1 is a signed number, negative when it represents a small outflow from the region as the drawing depicts, and positive when it represents a small inflow into the region, opposing the depicted arrows. Positive values of M1 essentially represent a dilution stream and possible source of contaminants that desirably are reduced and more desirably are made negative for the overall portion of the apparatus constituting interconnected close enclosures. M1' is the total net time-average mass flow of conditioned gas per unit width into the region from gas introduction device 318. If brought to a sufficient level, M1' reduces the particle count in the close enclosure. Excessively high M1' flows desirably are avoided in order to limit disturbance of substrate 312. M2 is the time-average mass flow per unit width from or into at least one major surface of the substrate into the region and through the chamber. M2 essentially represents evolution of volatile species or other material from substrate 312 into close enclosure 300. M3 is the total net time-average mass flow per unit width into the region and through the chamber resulting from motion of the substrate. M3 essentially represents gas swept along with the substrate in its motion. M4 is the time-average rate of mass transported per unit width through the gas withdrawal device 320. M4 represents the sum of M1+M1'+M2+M3.

Mass flow through a close enclosure may be assisted by employing a suitable seal with respect to the moving substrate (viz., a "moving substrate seal") at an upstream or downstream inlet or outlet of a close enclosure or connected chain of close enclosures. The seal may function as a sweep to prevent gas from entering or exiting the close enclosures. The seal could also include for example a forced gas, mechanical or retractable mechanical seal such as those shown in U.S. Pat. No. 6,553,689, or a pair of opposed nip rolls. A retractable mechanical sealing mechanism can allow passage of splices and other upset conditions. It may be desirable briefly to increase one or more nearby conditioned gas flow rates (or to decrease or switch one or more nearby gas withdrawal rates) to maintain the desired atmosphere near the seal. A pair of opposed nip rolls may be located for example, upstream or downs stream from the first or last dry converting station in a process.

By using a control surface in close proximity to the substrate surface, a supply of conditioned gas and a positive or small negative pressure gradient, a material particle count reduction may be obtained within a close enclosure. The pressure gradient, Δp, is defined as the difference between the pressure at the chamber's lower periphery, pc, and the pressure outside the chamber, po, wherein Δp=pc−po. Through appropriate use of conditioned gas and adjustment of the pressure gradient, particle count reductions of, for example, 50% or more, 75% or more, 90% or more or even 99% or more may be achieved. An exemplary pressure gradient is at least about −0.5 Pa or higher (viz., a more positive value). Another exemplary pressure gradient is a positive pressure gradient. As a general guide, greater pressures can be tolerated at higher moving substrate speeds. Greater pressures can also be tolerated when moving substrate seals are employed at the upstream and downstream ends of a series of interconnected close enclosures. Those skilled in the art will appreciate that the close enclosure pressure(s) may be adjusted based on these and other factors to provide a desirably low particle count within appropriate portions of the disclosed apparatus while avoiding undue substrate disturbance.

The disclosed process and apparatus may also substantially reduce the dilution gas flow, M1, transported through the chamber. The disclosed process and apparatus may, for example, limit M1 to an absolute value not greater than 0.25 kg/second/meter. M1 may be, for example, less than zero (in other words, representative of net outflow from the close enclosure) and greater than −0.25 kg/second/meter. In another exemplary embodiment, M1 may be less than zero and greater than −0.1 kg/second/meter. As is shown in the examples below, small negative enclosure pressures (which may correspond to slight positive M1 flows) can be tolerated. However, large negative enclosure pressures (which may correspond to large positive M1 flows) may cause adverse effects including dilution of mass in the adjacent gas phase, introduction of particles and other airborne contaminants, and introduction of uncontrolled ingredients, temperatures or humidity.

In one exemplary embodiment we control a process by appropriately controlling M1' and M4. A deliberate influx of a conditioned gas stream (e.g., a clean, inert gas having a controlled humidity) can materially promote a clean, controlled atmosphere in the close enclosure without unduly increasing dilution. By carefully controlling the volume and conditions under which M1' is introduced and M4 is withdrawn (and for example by maintaining a slight positive pressure in the close enclosure), flow M1 can be significantly curtailed and the close enclosure particle count can be significantly reduced. Additionally, the M1' stream may contain reactive or other components or optionally at least some components recycled from M4.

The headspace or footspace may be substantially uniform from the upstream end to the downstream end and across the width of the close enclosure. The headspace or footspace may also be varied or non-uniform for specific applications. The close enclosure may have a width wider than the substrate and desirably will have closed sides that further reduce time-average mass flow per unit width from pressure gradients (M1). The close enclosure can also be designed to conform to different geometry material surfaces. For example, the close enclosure can have a radiused periphery to conform to the surface of a cylinder.

The close enclosure may also include one or more mechanisms to control the phase of the mass transported through the close enclosure thereby controlling phase change of the components in the mass. For example, conventional temperature control devices may be incorporated into the close enclosure to prevent condensate from forming on the internal portions of the close enclosure. Non-limiting examples of suitable temperature control devices include heating coils, electrical heaters, external heat sources and heat transfer fluids.

Optionally, depending upon the composition of the gas phase composition, the withdrawn gas stream (M4) may be vented or filtered and vented after exiting the close enclosure. The gas phase composition may flow from one or more of the close enclosures to a subsequent processing location, e.g., without dilution. The subsequent processing may include such optional steps as, for example, separation or destruction of one or more components in the gas phase. The collected vapor stream may contain particulate matter which can be filtered prior to the separation process. Separation processing may also occur internally within the close enclosure in a controlled manner. Suitable separation or destruction processes will be familiar to those skilled in the art.

Figure 4:
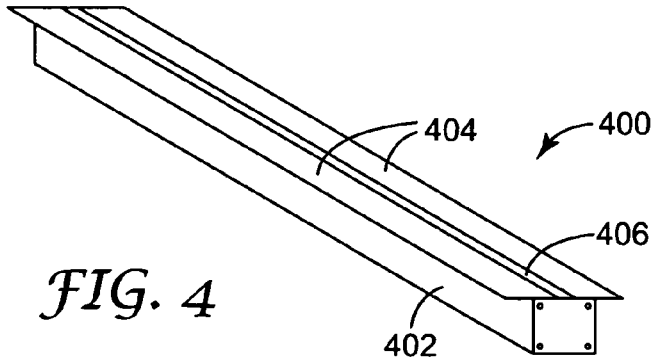
FIG. 4 is a perspective view of a disclosed distribution manifold.
Figure 5:
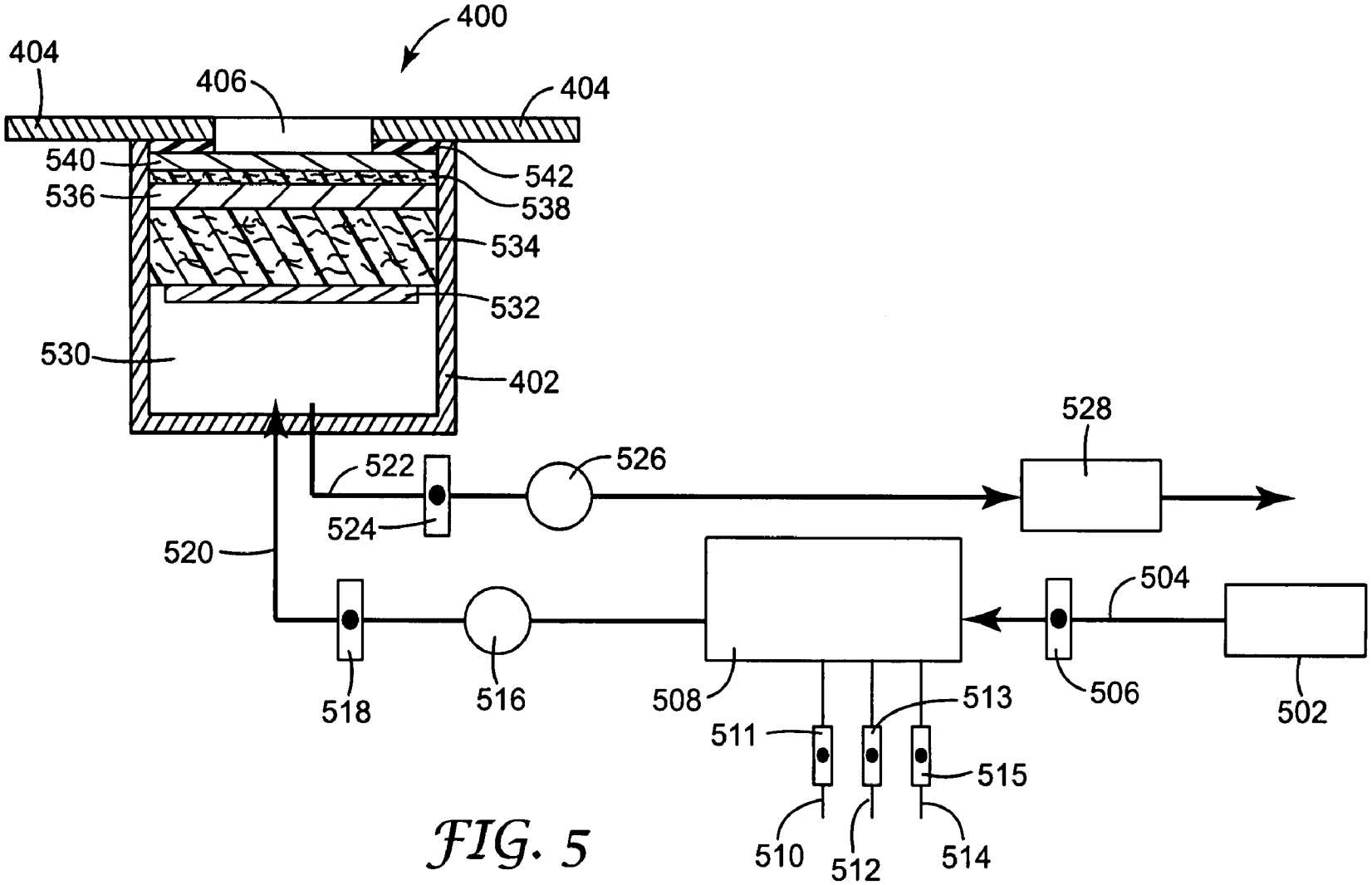
FIG. 5 is a partial schematic, partial cross sectional view of the distribution manifold of FIG. 4 and associated conditioned gas supply and gas withdrawal components.

It is desirable to avoid airflow patterns that might unduly disturb the substrate. FIG. 4 is a perspective view of a disclosed distribution manifold 400 that can assist in providing an even flow of supplied conditioned gas (M1'). Manifold 400 has a housing 402, and mounting flanges 404 flanking slit 406. Further details regarding manifold 400 are shown in FIG. 5, which is a schematic partial cross sectional view of manifold 400 and an associated gas conditioning system. Gas source 502 supplies a suitable gas (e.g., nitrogen or an inert gas) to gas conditioning system 508 via line 504 and valve 506. System 508 is optionally supplied with additional reactive species via lines 510, 512 and 514 and valves 511, 513 and 515. System 508 supplies the desired conditioned gas stream to manifold 400 via line 520, valve 516 and flow sensor 518. Vacuum line 522 may be used to withdraw gas from manifold 400 via flow sensor 524, valve 526 and vacuum pump 528. The presence of both a supply line and a vacuum line enables manifold 400 to be used as a conditioned gas introduction or gas withdrawal device. Gases entering manifold 400 pass through head space 520, around diverter plate 532, and through distribution media 534 (made, e.g., using white SCOTCHBRITE™ nonwoven fabric, commercially available from 3M Co.), and then pass through a first perforated plate 536, HEPA filter media 538 and a second perforated plate 540 before entering slit 406. Gasket 542 helps maintain a seal between flanges 404 and perforated plate 540. Manifold 400 can help supply a substantially uniform flow of supplied conditioned gas across the width of a close enclosure. The pressure drop laterally in the head space 520 is negligible in comparison to the pressure drop through the remaining components of manifold 400. Those skilled in the art will appreciate that the dimensions or shape of head space 520 and the pore size of distribution media 534 may be adjusted as needed to vary the flow rate across the length of distribution manifold 400 and along the width of a close enclosure. The flow rate along the length of distribution manifold 400 can also be adjusted by using an array of bolts or other suitable devices arranged to bear against diverter plate 532 and compress distribution media 534, thereby adjustably varying the pressure drop along the length of distribution manifold 400.

Figure 6:
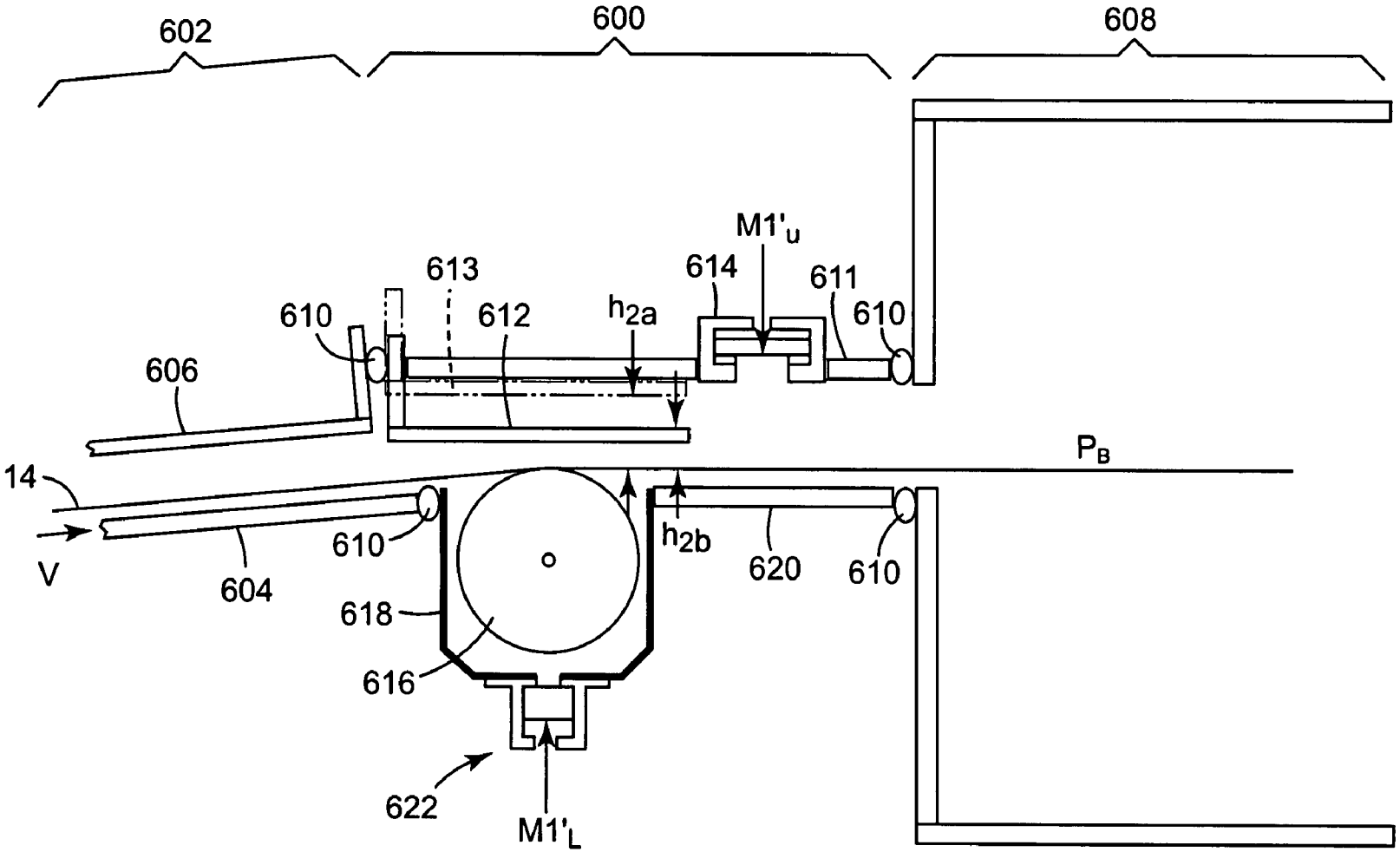
FIG. 6 is a schematic cross sectional view of a transport roll and distribution manifold.

FIG. 6 shows a close enclosure in the form of a transition zone 600 coupled at its upstream end to a process 602 having underlying control surface 604 and overlying control surface 606. The downstream end of transition zone 600 is coupled to process 608 operating at a pressure pB. Gaskets 610 provide a seal at each end of transition zone 600 and permit removal of the overlying or underlying control surfaces for, e.g., cleaning or web threadup. Transition zone 600 has a fixed overlying control surface 611 and a positionable overlying control surface 612 (shown in phantom in its raised position 613) that may be manually or automatically actuated to provide headspace values of h2*a*, h2*b* and values in between. Upper distribution manifold 614 may be used to supply conditioned gas stream M1'U. The underlying side of transition zone 600 has transport roll 616 inside housing 618, and underlying control surface 620. Lower distribution manifold 622 may be used to supply conditioned gas stream $M1'_L$. Transition zone 600 may be helpful in discouraging large gas flows between adjacent connected processes involving a material difference in respective operating pressures. Foe example, in some processes there may be a two-fold or greater, five-fold or greater or even ten-fold or greater pressure difference between processes at either end of the disclosed close enclosure and transition zone.

Figure 7:
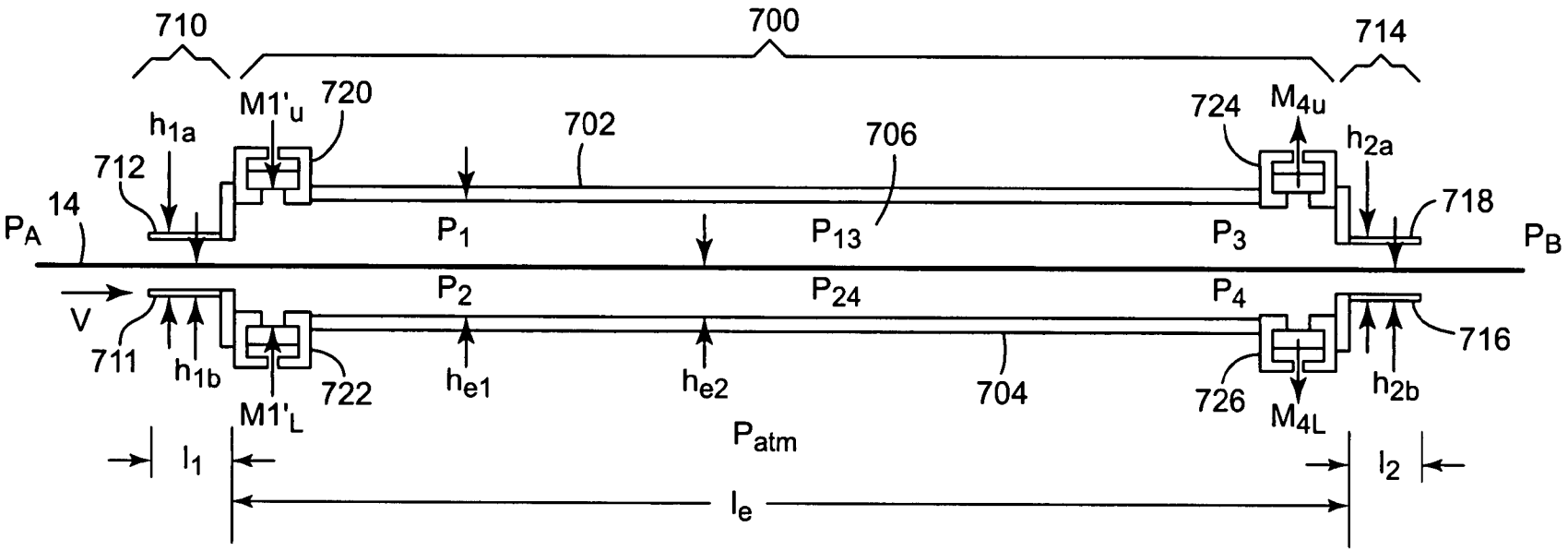
FIG. 7 is a schematic side sectional view of another disclosed close enclosure.
Figure 8:
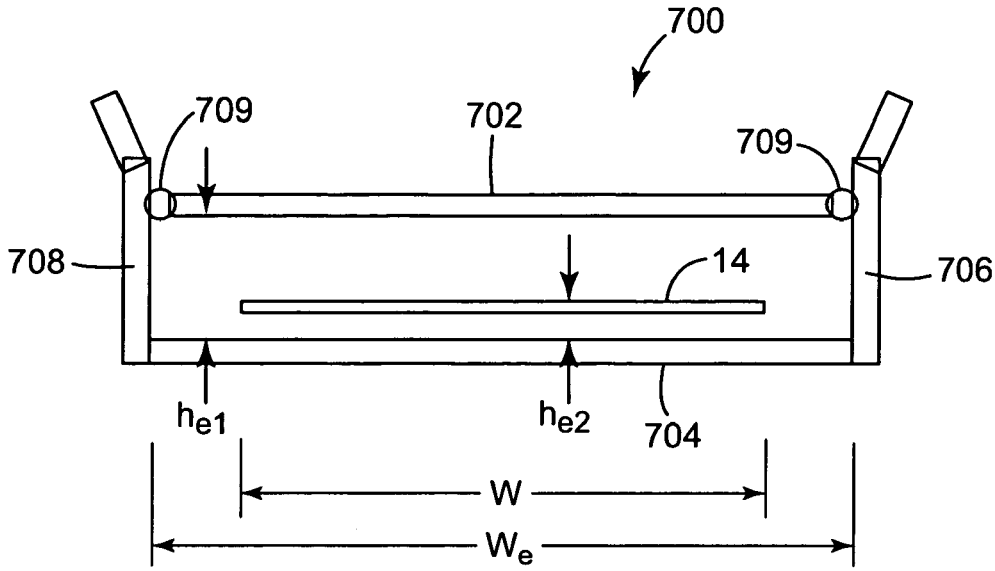
FIG. 8 is a schematic cross sectional view of the close enclosure of FIG. 7.

FIG. 7 and FIG. 8 respectively show a schematic sectional view and a cross sectional view of a close enclosure 700 having overlying control surface 702, underlying control surface 704 and sides 706 and 708. Close enclosure 700 has length $l_e$ and width $w_e$. Web 14 has width w, and is transported through close enclosure 700 at velocity V. Gaskets 709 provide a seal at the sides of overlying control surface 702 and permit its height adjustment or removal (e.g., for cleaning or web threadup). Overlying control surface 702 and underlying control surface 704 are spaced apart a distance $h_{e1}$. Underlying control surface 704 is spaced apart from substrate 14 a distance $h_{e2}$. These distances may vary in the upstream or downstream directions. Upstream transition zone 710 has underlying and overlying web slot pieces 711 and 712. These web slot pieces are spaced apart a distance $h_{1a}$, and have length $l_1$. Underlying web slot piece 711 is spaced apart from web 14 a distance $h_{1b}$. An upstream process (not shown in FIG. 7 or FIG. 8) is in direct gaseous communication with transition zone 710 and has pressure $P_A$. Downstream transition zone 714 has underlying and overlying web slot pieces 716 and 718. These web slot pieces are spaced apart a distance $h_{2a}$, and have length $l_2$. Underlying web slot piece 716 is spaced apart from web 14 a distance $h_{2b}$. A downstream process (not shown in FIG. 7 or FIG. 8) is in direct gaseous communication with transition zone 714 and has pressure $P_B$. When an upstream or downstream process is required to operate at a large pressure differential from an enclosure such as close enclosure 700, the transition zones between the upstream or downstream process and the close enclosure may utilize additional dilution (or exhaust) streams to decrease the pressure differential between the process and the close enclosure. For example, convection ovens often operate at large negative pressures (−25 Pa is not uncommon), inducing large gas flows.

Upper and lower manifolds 720 and 722 respectively may provide gas flows into or out of the upstream end of close enclosure 700 (e.g., conditioned gas streams $M1'_U$ and $M1'_L$). Upper and lower manifolds 724 and 726 respectively may provide gas flows into or out of the upstream end of close enclosure 700 (e.g., withdrawn gas streams $M4_U$ and $M4_L$). The pressures inside the enclosure can be characterized by $P_1$, $P_2$, $P_{13}$, $P_{23}$, $P_3$ and $P_4$. The ambient air pressure outside close enclosure 700 is given by $P_{atm}$.

The disclosed process and apparatus typically will utilize a web handling system to transport a moving substrate of indefinite length through the apparatus. Those skilled in the art will be familiar with suitable material handling systems and devices. Those skilled in the art will also appreciate that a wide variety of substrates may be employed, including, for example, a polymer, woven or non-woven material, fibers, powder, paper, a food product, pharmaceutical product or combinations thereof. The disclosed process and apparatus may also be used, for example to clean or prime a substrate prior to the application of a coating, as described in copending U.S. patent application Ser. No. 10/810,069 filed Mar. 26, 2004 and entitled "COATING PROCESS AND APPARATUS", the disclosure of which is incorporated herein by reference.

In operation, exemplary embodiments of the disclosed apparatus can significantly reduce the particle count in the atmosphere surrounding a moving web. Exemplary embodiments of the disclosed apparatus may also capture at least a portion of a vapor component from a substrate (if present) without substantial dilution and without condensation of the vapor component. The supplied conditioned gas may significantly reduce the introduction of particulates into portions of the apparatus surrounding the substrate and thus may reduce or prevent product quality problems in the finished product. The relatively low air flow may significantly reduce disturbances to the substrate and thus may further reduce or prevent product quality problems.

EXAMPLE 1

Figure 9:
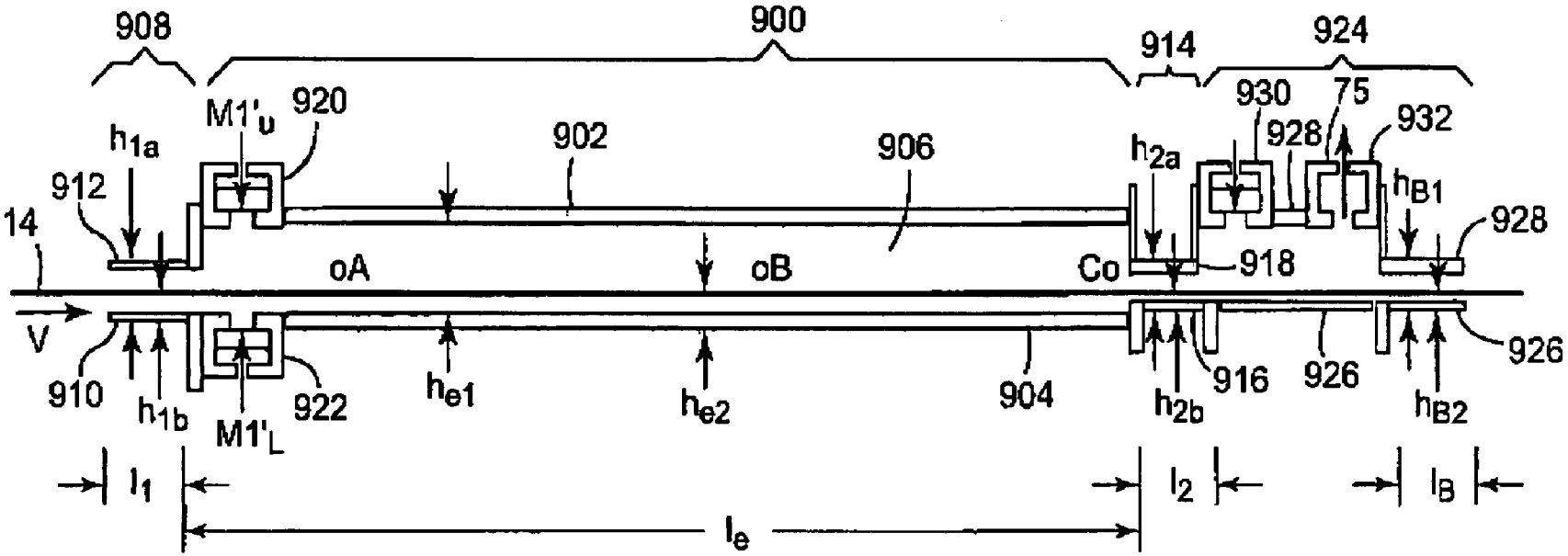
FIG. 9 is a schematic side sectional view of another disclosed close enclosure.

A single close enclosure was constructed to illustrate the effect of certain variables. FIG. 9 shows a schematic side sectional view of a close enclosure 900. Close enclosure 900 has overlying control surface 902, underlying control surface 904 and side 906 equipped with sample ports A, B and C for measuring pressure, particle count and oxygen levels within close enclosure 900. Overlying control surface 902 and underlying control surface 904 are spaced apart a distance $h_{e1}$. Underlying control surface 904 is spaced apart from substrate 14 a distance $h_{e2}$. Upstream transition zone 908 has underlying and overlying web slot pieces 910 and 912. These web slot pieces are spaced apart a distance $h_{1a}$, and have length $l_1$. Underlying web slot piece 910 is spaced apart from web 14 a distance $h_{1b}$. Downstream transition zone 914 has underlying and overlying web slot pieces 916 and 918. These web slot pieces are spaced apart a distance $h_{2a}$, and have length $l_2$. Underlying web slot piece 916 is spaced apart from web 14 a distance $h_{2b}$. Upper and lower distribution manifolds 920 and 922 respectively supply conditioned gas streams $M1'_U$ and $M1'_L$ at the upstream end of close enclosure 900. Web 14 is transported through close enclosure 900 at velocity V.

Downstream process 924 has movable underlying control surface 926, overlying control surface 928 equipped with ambient gas inlet 930 and vacuum outlet 932, and underlying and overlying web slot pieces 926 and 928. These web slot pieces are spaced apart a distance $h_{B1}$. Underlying web slot piece 926 is spaced apart from web 14 a distance $h_{B2}$. These web slot pieces have length $l_3$. Through appropriate regulation of the flows through inlet 930 and outlet 932, process 924 can simulate a variety of devices.

For purposes of this example close enclosure 900 was used with an uncoated web and was not connected at either its upstream or downstream ends to another close enclosure. Thus the surrounding room, with a defined ambient pressure of zero, lies upstream from transition zone 908 and downstream from process 924. The room air temperature was about 20° C.

Figure 10:
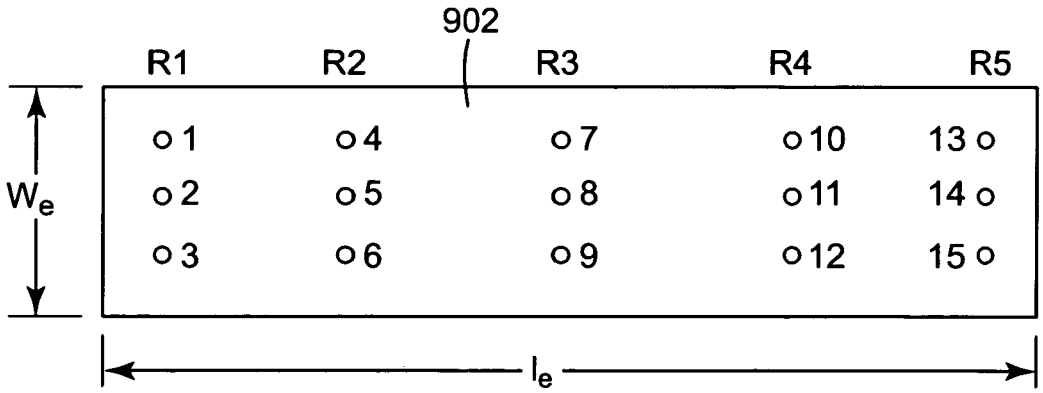
FIG. 10 is a schematic plan view of the overlying control surface in FIG. 9.

FIG. 10 shows a plan view of overlying control surface 902. Surface 902 has length $l_e$ and width $w_e$, and contains 5 rows of 3 numbered holes each having a 9.78 mm diameter and a 0.75 $cm^2$ area, with the lowest numbered holes located at the upstream end of control surface 902. The holes can be used as sample ports for measuring pressure, particle count and oxygen levels at different locations within the enclosure and may also be left open or taped closed to vary the open draft area of close enclosure 900.

Particle counts were measured using a MET ONE™ Model 200L-1-115-1 Laser Particle Counter (commercially available from Met One Instruments, Inc.), to determine the number of 0.5 μm or larger particles in a volume of 28.3 liters, at a 28.3 liters/min flow rate. Pressures were measured using a Model MP40D micromanometer (commercially available from Air-Neotronics Ltd.). Oxygen levels were measured using a IST-AIM™ Model 4601 Gas Detector (commercially available from Imaging and Sensing Technology Corporation). Gas velocities were evaluated using a Series 490 Mini Anemometer (commercially available from Kurz Instruments, Inc.).

Upper and lower distribution manifolds 920 and 922 were connected to a nitrogen supply and the flow rates adjusted using DWYER™ Model RMB-56-SSV flow meters (commercially available from Dwyer Instruments, Inc.). Vacuum outlet 932 was connected to a NORTEC™ Model 7 compressed air driven vacuum pump (commercially available from Nortec Industries, Inc.). The flow rate was adjusted using a pressure regulator and a DWYER Model RMB-106 flow meter (commercially available from Dwyer Instruments, Inc.).

Figure 11:
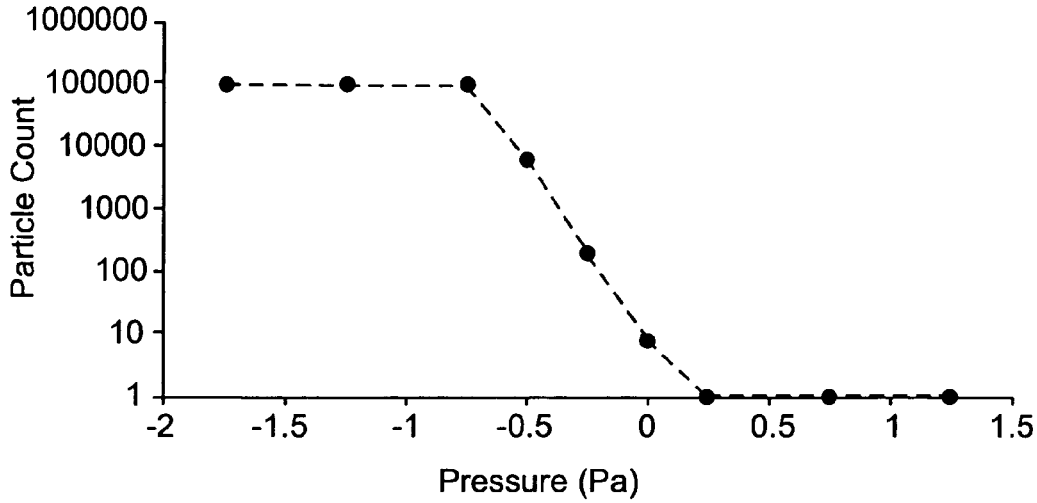
FIG. 11 is a graph showing particle count versus pressure in a disclosed close enclosure.
Figure 12:
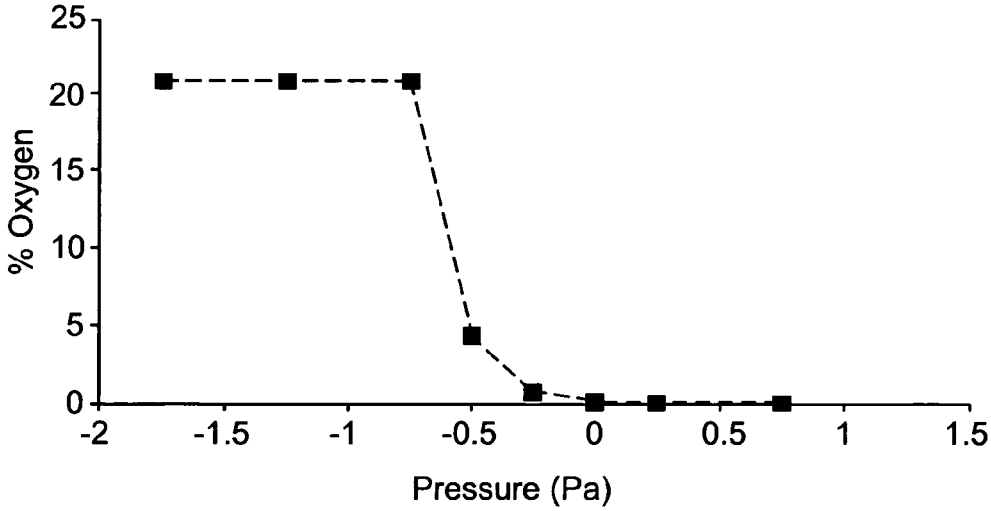
FIG. 12 is a graph showing oxygen level versus pressure in a disclosed close enclosure.

Close enclosure 900 was adjusted so that $l_e$=156.2 cm, $w_e$=38.1 cm, $h_{e1}$=4.45 cm, $h_{e2}$=0.95 cm, $h_{1a}$=0.46 cm, $h_{1b}$=0.23 cm, $l_1$=7.62 cm, $h_{2a}$=1.27 cm, $h_{2b}$=0.13 cm, $l_2$=3.8 cm, $h_{B1}$=0.46 cm, $h_{B2}$=0.23 cm, $l_3$=2.54 cm and V=0. The enclosure pressure was adjusted by varying the flow rates $M1'_U$ and $M1'_L$ and the rate of gas withdrawal at outlet 932, using sample port B (see FIG. 9) to monitor pressure. Hole 11 (see FIG. 10) was used to monitor particle count and sample port C (see FIG. 9) was used to monitor the oxygen level. Inlet 930, the remaining holes in control surface 902 and sample port A were taped closed, thereby providing a minimal open draft area in close enclosure 900. The results are shown in FIG. 11 (which uses a logarithmic particle count scale) and FIG. 12 (which uses a linear oxygen concentration scale), and demonstrate that for a stationary web, material particle count reductions were obtained, at, e.g., pressures greater than or equal to about −0.5 Pa. At positive enclosure pressures, the particle counts were at or below the instrument detection threshold. The curves for particle count and oxygen level were very similar to one another.

EXAMPLE 2

Figure 13:
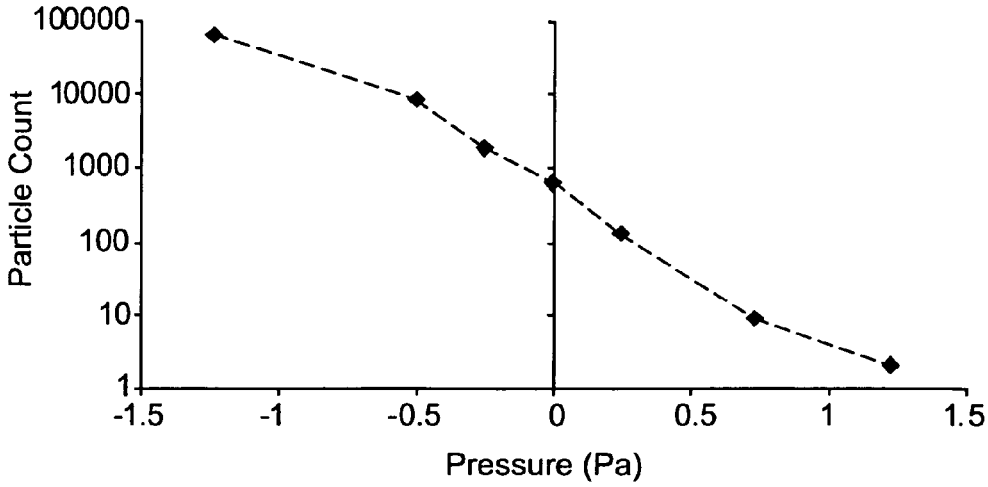
FIG. 13 is a graph showing particle count versus pressure in a disclosed close enclosure.

Example 1 was repeated using an 18 m/minute web velocity V. The particle count results are shown in FIG. 13 (which uses a logarithmic particle count scale). FIG. 13 demonstrates that for a moving web, material particle count reductions were obtained, at, e.g., pressures greater than −0.5 Pa.

EXAMPLE 3

Figure 14:
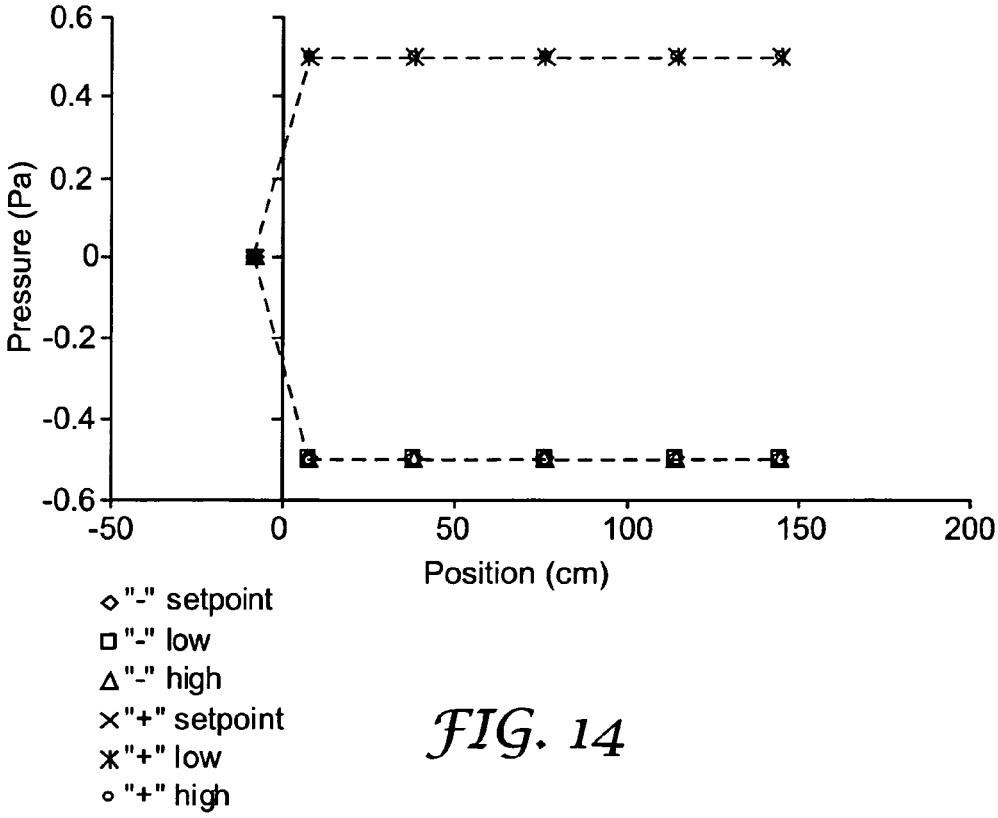
FIG. 14 is a graph showing pressures at various positions within a disclosed close enclosure.

Using the method of Example 1, a −0.5 Pa enclosure pressure was obtained in close enclosure 900 by adjusting the flow rates $M1'_U$ and $M1'_L$ to 24 liters/min and by adjusting the rate of gas withdrawal at outlet 932 to 94 liters/min. In a separate run, a +0.5 Pa enclosure pressure was obtained by adjusting the flow rates $M1'_U$ and $M1'_L$ to 122 liters/min and by adjusting the rate of gas withdrawal at outlet 932 to 94 liters/min. The respective particle counts were 107,889 at −0.5 Pa, and only 1 at +0.5 Pa. For each run the enclosure pressure above the substrate was measured at several points along the length of close enclosure 900 using holes 2, 5, 8, 11 and 14 (see FIG. 10). As shown in FIG. 14, the enclosure pressure above the substrate was very steady for each run and did not measurably vary along the length of close enclosure 900. Similar measurements were made below the web using ports A, B and C. No variation in pressure was observed in those measurements either.

Figure 15:
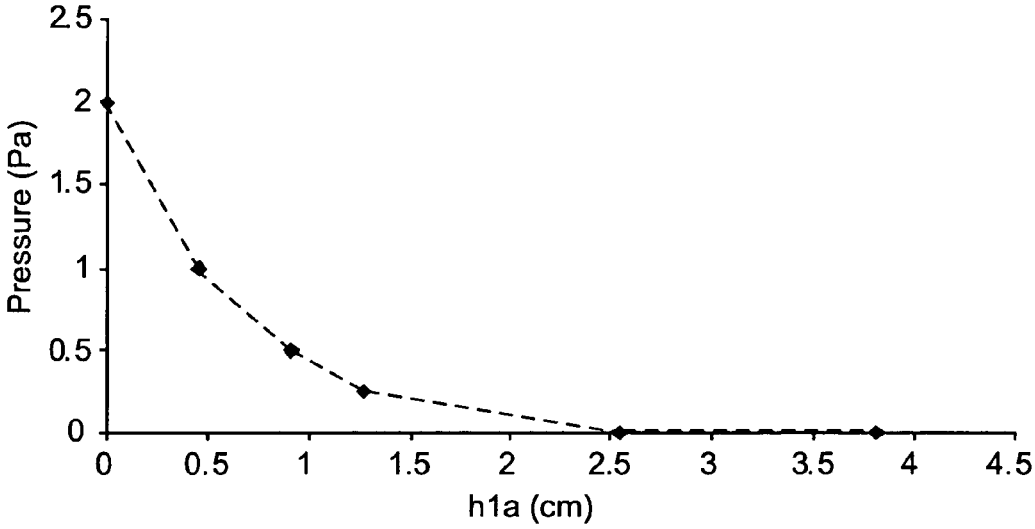
FIG. 15 is a graph showing pressure versus web slot height for a disclosed close enclosure.

In a comparison run, pressure measurements were made at varying points inside and outside a TEC™ air flotation oven (manufactured by Thermal Equipment Corp.) equipped with a HEPA filter air supply set to maintain a −0.5 Pa enclosure pressure. The upper and lower flotation air bar pressures were set to 250 Pa. The make-up air flowed at 51,000 liters/min (equivalent to about 7.5 air changes/minute for a 6800 liter oven capacity, not taking into account equipment inside the oven). The ambient room air particle count was 48,467. The particle count measured approximately 80 centimeters inside the oven was 35,481. The particle counts at several other positions were measured as shown in FIG. 15. FIG. 15 demonstrates that the enclosure pressure varied considerably at the various measuring points, and exhibited further variation due to the action of the oven pressure regulator.

EXAMPLE 4

Figure 16:
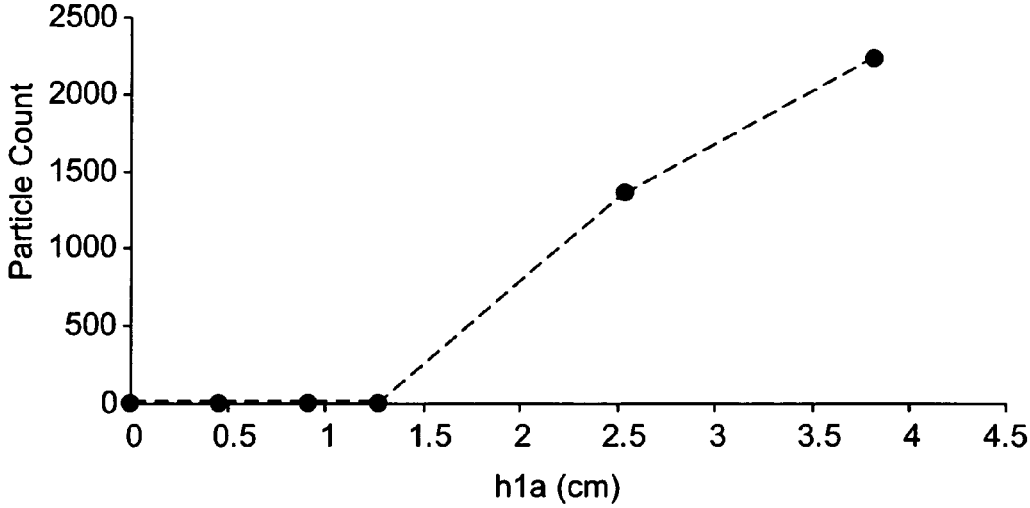
FIG. 16 is a graph showing particle count versus web slot height for a disclosed close enclosure.
Figure 17:
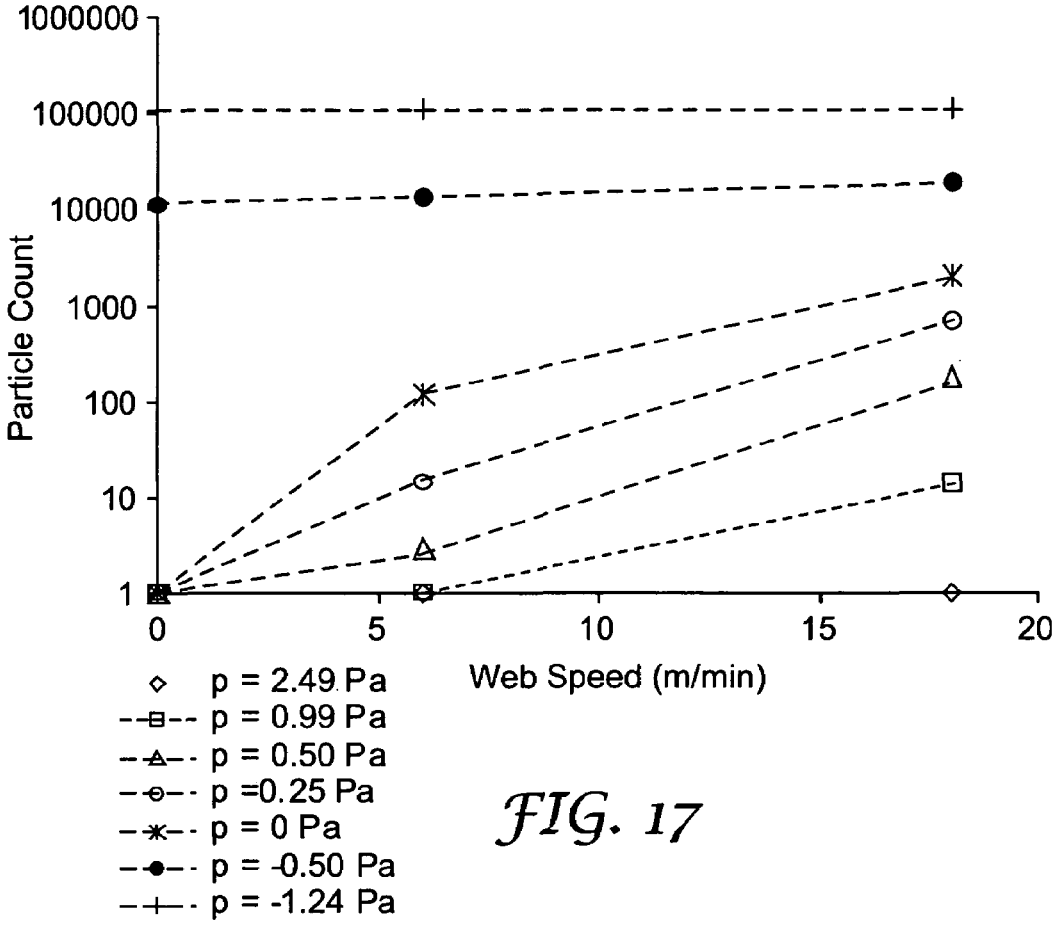
FIG. 17 is a graph showing particle count versus web speed at various pressures for a disclosed close enclosure.

Using the general method of Example 1, the $M1'_U$ and $M1'_L$ flow rates were set at 122 liters/min and the rate of gas withdrawal at outlet 932 was set at 94 liters/min. The web slot height $h_{1a}$ was adjusted to values of 0, 0.46, 0.91, 1.27, 2.54 and 3.81 cm. The ambient air particle count was 111,175. FIG. 16 and FIG. 17 (which both use linear vertical axis scales) respectively show the pressure and particle count inside the enclosure at various web slot heights. In all instances, a material particle count reduction (compared to the ambient air particle count) was obtained.

EXAMPLE 5

Using the general method of Example 1 and a 23 cm wide polyester film substrate moving at 0, 6 or 18 m/min, the $M1'_U$ and $M1'_L$ flow rates and the rate of gas withdrawal at outlet 932 were adjusted to obtain varying enclosures pressures. The ambient air particle count was 111,175. The enclosure particle count was measured as a function of web speed and enclosure pressure. The results are shown in FIG. 18 (which uses a logarithmic particle count scale). FIG. 18 demonstrates that material particle count reductions were obtained for all measured substrate speeds at, e.g., pressures greater than −0.5 Pa.

From the above disclosure of the general principles of the disclosed invention and the preceding detailed description, those skilled in this art will readily comprehend the various modifications to which the disclosed invention is susceptible. Therefore, the scope of the invention should be limited only by the following claims and equivalents thereof.

I claim:

1. A process for dry converting a moving substrate comprising:

unwinding a web substrate; and conveying the substrate through a dry converting station in a close enclosure while supplying the enclosure with one or more streams of conditioned gas flowing at a rate sufficient to reduce materially the particle count in the close enclosure.

2. A process according to claim 1 comprising conveying the substrate through a series of interconnected close enclosures.

3. A process according to claim 1 comprising conveying the substrate in a close enclosure or series of close enclosures through at least a first dry converting station in the process.

4. A process according to claim 1 comprising conveying the substrate in a close enclosure or series of close enclosures through at least a last dry converting station in the process.

5. A process according to claim 1 comprising conveying the substrate in a close enclosure or series of close enclosures from at least a first dry converting station in the process through at least a last dry converting station in the process.

6. A process according to claim 1 comprising conveying the substrate in a close enclosure or series of close enclosures from at least a first dry converting station in the process up to a takeup reel or up to or through a packaging station.

7. A process for dry converting a moving substrate of indefinite length comprising conveying the substrate through a dry converting station in a close enclosure while supplying the enclosure with one or more streams of conditioned gas flowing at a rate sufficient to reduce materially the particle count in the close enclosure, the process further comprising conveying the substrate in a close enclosure or series of close enclosures from a cabinet containing an unwind reel to a cabinet containing a takeup reel.

8. A process according to claim 1 wherein at least two close enclosures have different pressures, temperatures, average headspaces or average footspaces.

9. A process according to claim 1 comprising maintaining or establishing a positive pressure in at least one close enclosure and maintaining or establishing a negative pressure in at least one other close enclosure.

10. A process for dry converting a moving substrate of indefinite length comprising conveying the substrate through a dry converting station in a close enclosure while supplying the enclosure with one or more steams of conditioned gas flowing at a rate sufficient to reduce materially the particle count in the close enclosure, the process further comprising supplying a conditioned gas stream to at least the first in a series of interconnected close enclosures whereby the conditioned gas is carried along with the moving substrate to a downstream close enclosure or pushed to an upstream enclosure or process.

11. A process for dry converting a moving substrate of indefinite length comprising conveying the substrate through a dry converting station in a close enclosure while supplying the enclosure with one or more streams of conditioned gas flowing at a rate sufficient to reduce materially the particle count in the close enclosure, the process further comprising supplying conditioned gas streams to a plurality of close enclosures and withdrawing gas from a plurality of close enclosures.

12. A process according to claim 1 comprising supplying conditioned gas streams to each in a series of interconnected close enclosures.

13. A process according to claim 1 comprising sealing the moving substrate at the upstream and downstream ends of a series of interconnected close enclosures.

14. A process according to claim 1 comprising maintaining a pressure gradient of at least about −0.5 Pa or higher in a close enclosure.

15. A process according to claim 1 comprising maintaining a positive pressure gradient in a close enclosure.

16. A process according to claim 1 comprising connecting first and second enclosures having a material difference in their respective operating pressures via a close enclosure comprising a transition zone.

17. A process according to claim 16 wherein there is a ten-fold or greater pressure difference between atmospheres in the first and second enclosures.

18. A process according to claim 1 wherein the total of the average headspace and average footspace in a close enclosure is 10 cm or less.

19. A process for dry converting a moving substrate of indefinite length comprising conveying the substrate through a dry converting station in a close enclosure while supplying the enclosure with one or more streams of conditioned gas flowing at a rate sufficient to reduce materially the particle count in the close enclosure, wherein the total of the average headspace and average footspace in a close enclosure is 5 cm or less.

20. A process according to claim 19 wherein the total of the average headspace and average footspace in any close enclosure is 3 cm or less.

21. A process for dry converting a moving substrate of indefinite length comprising conveying the substrate through a dry converting station in a close enclosure while supplying the enclosure with one or more streams of conditioned gas flowing at a rate sufficient to reduce materially the particle count in the close enclosure, wherein a first chamber having a gas introduction device is positioned near a control surface, a second chamber having a gas withdrawal device is positioned near the control surface, the control surface and first and second chambers together define a region wherein adjacent gas phases possess an amount of mass, at least a portion of the mass from the adjacent gas phases is transported through the gas withdrawal device by inducing a flow through the region, and the mass flow can be segmented into the following components:

M1 means total net time-average mass flow per unit of substrate width into or out of the region resulting from pressure gradients, M1' means the total net time-average mass flow of a gas per unit width into the region through the first chamber from the gas introduction device, M2 means the time-average mass flow of conditioned gas per unit width from or into the at least one major surface of the substrate into or from the region, M3 means total net time-average mass flow per unit width into the region resulting from motion of the material, and M4 means time-average rate of mass transport through the gas withdrawal device per unit width.

22. A process according to claim 21 wherein M1 has a value less than zero and greater than −0.25 kg/second/meter.

23. A process according to claim 21 wherein M1 has a value less than zero and greater than −0.10 kg/second/meter.

24. A process according to claim 1 comprising flowing a stream of conditioned gas at a rate sufficient to reduce a close enclosure particle count by 75% or more.

25. A process according to claim 1 comprising flowing streams of conditioned gas at a rate sufficient to reduce the close enclosure particle counts by 90% or more.

26. An apparatus for converting a moving web substrate, the apparatus comprising an unwind reel, dry converting station and web-handling equipment for conveying the substrate from the unwind reel through the dry converting station, the substrate being enveloped in the dry converting station by a close enclosure supplied with one or more streams of conditioned gas flowing at a rate sufficient to reduce materially the particle count in the close enclosure.

27. An apparatus according to claim 26 wherein the substrate is conveyed through a series of interconnected close enclosures.

28. An apparatus according to claim 26 wherein the substrate is enveloped by a close enclosure or series of close enclosures through at least a first dry converting station in the apparatus.

29. An apparatus according to claim 26 wherein the substrate is enveloped by a close enclosure or series of close enclosures through at least a last dry converting station in the apparatus.

30. An apparatus according to claim 26 wherein the substrate is enveloped by a close enclosure or series of close enclosures from at least a first dry converting station in the apparatus through at least a last dry converting station in the apparatus.

31. An apparatus according to claim 26 wherein the substrate is enveloped in a close enclosure or series of close enclosures from at least a first dry converting station in the apparatus up to a takeup reel or up to or through a packaging station.

32. An apparatus for converting a moving substrate of indefinite length comprising a dry converting station and substrate-handling equipment for conveying the substrate through the dry converting station, the substrate being enveloped in the dry converting station by a close enclosure supplied with one or more streams of conditioned gas flowing at a rate sufficient to reduce materially the particle count in the close enclosure, wherein the substrate is enveloped in a close enclosure or series of close enclosures from a cabinet containing an unwind reel to a cabinet containing a takeup reel.

33. An apparatus according to claim 26 wherein at least two close enclosures have different average headspaces or average footspaces.

34. An apparatus for converting a moving substrate of indefinite length comprising a dry converting station and substrate-handling equipment for conveying the substrate through the dry converting station, the substrate being enveloped in the dry converting station by a close enclosure supplied with one or more streams of conditioned gas flowing at a rate sufficient to reduce materially the particle count in the close enclosure, wherein a conditioned gas stream is supplied to at least the first in a series of interconnected close enclosures and the conditioned gas is carried along with the moving substrate to a downstream close enclosure or pushed to an upstream enclosure or process.

35. An apparatus for converting a moving substrate of indefinite length comprising a dry converting station and substrate-handling equipment for conveying the substrate through the dry converting station, the substrate being enveloped in the dry converting station by a close enclosure supplied with one or more streams of conditioned gas flowing at a rate sufficient to reduce materially the particle count in the close enclosure, wherein conditioned gas streams are supplied to a plurality of close enclosures and gas streams are withdrawn from a plurality of close enclosures.

36. An apparatus according to claim 26 wherein conditioned gas streams are supplied to each in a series of interconnected close enclosures.

37. An apparatus according to claim 26 having seals with respect to the moving substrate at the upstream and downstream ends of a series of interconnected close enclosures.

38. An apparatus according to claim 26 wherein a close enclosure has a pressure gradient of at least about −0.5 Pa or higher.

39. An apparatus according to claim 26 wherein a close enclosure has a positive pressure gradient.

40. An apparatus for converting a moving substrate of indefinite length comprising a dry converting station and substrate-handling equipment for conveying the substrate through the dry converting station, the substrate being enveloped in the dry converting station by a close enclosure supplied with one or more streams of conditioned gas flowing at a rate sufficient to reduce materially the particle count in the close enclosure, the apparatus further comprising first and second enclosures having a material difference in their respective operating pressures connected by a close enclosure comprising a transition zone between the first and second enclosures.

41. An apparatus according to claim 40 wherein there is a ten-fold or greater pressure difference between atmospheres in the first and second enclosures.

42. An apparatus according to claim 26 wherein the total of the average headspace and average footspace in a close enclosure is 10 cm or less.

43. An apparatus for converting a moving substrate of indefinite length comprising a dry converting station and substrate-handling equipment for conveying the substrate through the dry converting station, the substrate being enveloped in the dry converting station by a close enclosure supplied with one or more streams of conditioned gas flowing at a rate sufficient to reduce materially the particle count in the close enclosure, wherein the total of the average headspace and average footspace in a close enclosure is 5 cm or less.

44. An apparatus according to claim 43 wherein the total of the average head space and average footspace in any close enclosure is 3 cm or less.

45. An apparatus for converting a moving substrate of indefinite length comprising a dry converting station and substrate-handling equipment for conveying the substrate through the dry converting station, the substrate being enveloped in the dry converting station by a close enclosure supplied with one or more streams of conditioned gas flowing at a rate sufficient to reduce materially the particle count in the close enclosure, wherein a first chamber having a gas introduction device is positioned near a control surface, a second chamber having a gas withdrawal device is positioned near the control surface, the control surface and first and second chambers together define a region wherein adjacent gas phases possess an amount of mass, at least a portion of the mass from the adjacent gas phases can be transported through the gas withdrawal device by inducing a flow through the region, and the mass flow can be segmented into the following components:

- M1 means total net time-average mass flow per unit of substrate width into or out of the region resulting from pressure gradients,
- M1' means the total net time-average mass flow of a gas per unit width into the region through the first chamber from the gas introduction device,
- M2 means the time-average mass flow of conditioned gas per unit width from or into the at least one major surface of the substrate into or from the region,
- M3 means total net time-average mass flow per unit width into the region resulting from motion of the material, and
- M4 means time-average rate of mass transport through the gas withdrawal device per unit width.

46. An apparatus according to claim 45 wherein M1 has a value less than zero and greater than −0.25 kg/second/meter.

47. An apparatus according to claim 45 wherein M1 has a value less than zero and greater than −0.10 kg/second/meter.

48. An apparatus according to claim 26 wherein a stream of conditioned gas flows at a rate sufficient to reduce a close enclosure particle count by 75% or more.

49. An apparatus according to claim 26 wherein the streams of conditioned gas flow at a rate sufficient to reduce the close enclosure particle counts by 90% or more.

50. A process for dry converting a moving substrate comprising:

unwinding a web substrate; and conveying the substrate through a dry converting station in a close enclosure while supplying the enclosure with one or more streams of conditioned gas flowing at a rate sufficient to cause a material change in a physical property of interest for the atmosphere in the close enclosure.

51. An apparatus for converting a moving web substrate, the apparatus comprising an unwind reel, dry converting station and web-handling equipment for conveying the substrate from the unwind reel through the dry converting station, the substrate being enveloped in the dry converting station by a close enclosure supplied with one or more streams of conditioned gas flowing at a rate sufficient to cause a material change in a physical property of interest for the atmosphere in the close enclosure.

52. An apparatus according to claim 51 wherein the total of the average headspace and average footspace in a close-coupled enclosure is 10 cm or less.

53. A process according to claim 50 wherein the total of the average headspace and average footspace in a close-coupled enclosure is 10 cm or less.

54. An apparatus according to claim 49 wherein the total of the average headspace and average footspace in a close-coupled enclosure is 10 cm or less.

55. An apparatus for converting a moving substrate of indefinite length comprising a dry converting station and substrate-handling equipment for conveying the substrate through the dry converting station, the substrate being enveloped in the dry converting station by a close enclosure supplied with one or more steams of conditioned gas flowing at a rate sufficient to reduce materially the particle count in the close enclosure, wherein the streams of conditioned gas flow at a rate sufficient to reduce the close enclosure particle counts by 90% or more and the total of the average headspace and average footspace in a close-coupled enclosure is 3 cm or less.

56. An apparatus according to claim 55 wherein the total of the average headspace and average footspace in a close-coupled enclosure is 2 cm or less.

57. An apparatus according to claim 55 wherein the total of the average headspace and average footspace in a close-coupled enclosure is 1.5 cm or less.

58. A process according to claim 25 wherein the total of the average headspace and average footspace in a close-coupled enclosure is 10 cm or less.

59. A process for dry converting a moving substrate of indefinite length comprising conveying the substrate through a dry converting station in a close enclosure while supplying the enclosure with one or more streams of conditioned gas flowing at a rate sufficient to reduce materially the particle count in the close enclosure, the process comprising flowing streams of conditioned gas at a rate sufficient to reduce the close enclosure particle counts by 90% or more, wherein the total of the average headspace and average footspace in a close-coupled enclosure is 3 cm or less.

60. A process according to claim 59 wherein the total of the average headspace and average footspace in a close-coupled enclosure is 2 cm or less.

61. A process according to claim 59 wherein the total of the average headspace and average footspace in a close-coupled enclosure is 1.5 cm or less.

62. A process according to claim 1 further comprising coating the substrate and forming the coated substrate into a roll.

63. An apparatus according to claim 26 further comprising a takeup reel or packaging station.

64. A process according to claim 50 further comprising coating the substrate and forming the coated substrate into a roll.

65. An apparatus according to claim 51 further comprising a takeup reel or packaging station.

* * * * *

UNITED STATES PATENT AND TRADEMARK OFFICE

CERTIFICATE OF CORRECTION

PATENT NO. : 7,143,528 B2
APPLICATION NO. : 10/810065
DATED : December 5, 2006
INVENTOR(S) : William B. Kolb It is certified that error appears in the above-identified patent and that said Letters Patent is hereby corrected as shown below:

On Page 2 of Title Pages, Col. 2, under (U.S. Patent Documents), line 7, after "6,553,689" delete "B1" and insert -- B2 --, therefor.

Col. 11, line 4, delete "M1'U." and insert -- $M1'_U$. --, therefor.

Col. 15, line 41, in Claim 10, delete "steams" and insert -- streams --, therefor.

Col. 18, line 35, in Claim 44, delete "head space" and insert --headspace--, therefor.

Col. 19, line 45, in Claim 55, delete "steams" and insert -- streams --, therefor.

Signed and Sealed this

Twenty-second Day of May, 2007

JON W. DUDAS
*Director of the United States Patent and Trademark Office*